United States Patent [19]

Walther

[11] 4,308,300

[45] Dec. 29, 1981

[54] PROCESS FOR COATING THE CUTTER PARTS OF AN ELECTRIC DRY SHAVER WITH PREPARATION INCLUDING A SOLID LUBRICANT

[75] Inventor: Werner Walther, Schwalbach, Fed. Rep. of Germany

[73] Assignee: Braun Aktiengesellschaft, Kronberg, Fed. Rep. of Germany

[21] Appl. No.: 157,711

[22] Filed: Jun. 9, 1980

[30] Foreign Application Priority Data

Jul. 19, 1979 [DE] Fed. Rep. of Germany ..... 2929164

[51] Int. Cl.[3] ..... B05D 5/00

[52] U.S. Cl. ..... 427/287; 30/32; 427/282

[58] Field of Search ..... 427/282, 287; 30/32

[56] References Cited

U.S. PATENT DOCUMENTS 3,501,334 3/1970 Flaherty ..... 427/287

FOREIGN PATENT DOCUMENTS 519582 4/1972 Sweden .

*Primary Examiner*—Michael R. Lusignan
*Assistant Examiner*—Janyce A. Bell
*Attorney, Agent, or Firm*—Raymond J. De Vellis

[57] ABSTRACT

A coating of the cutter parts of an electric dry shaver with a solid lubricant is accomplished by positioning a meshed member over the surface of the cutter parts and then penetrating the meshed member with a solid lubricant preparation. The meshed member is then pulled from the coated cutter parts.

9 Claims, No Drawings

PROCESS FOR COATING THE CUTTER PARTS OF AN ELECTRIC DRY SHAVER WITH PREPARATION INCLUDING A SOLID LUBRICANT

BACKGROUND OF THE INVENTION

This invention relates to a process for the coating of cutting parts for an electric dry shaver with a preparation containing solid lubricants.

As shown in Swiss Pat. No. 519.582, it is known to apply solid lubricants to the entire surface of cutting parts for an electric dry shaver through the process of electroplating.

The drawback of this prior art technique is that the resulting cutting edges and insides of the hair entrance ports of the coated cutting parts are also coated with the solid lubricant. This leads to a radiusing of the cutting edges and a narrowing of the hair entrance ports. Therefore, a considerable overall reduction of the cutting performance is realized.

Accordingly, this invention overcomes the disadvantage of prior art techniques by making a process available by which the cutting parts of an electric dry shaver are coated with a preparation containing a solid lubricant but that the cutting edges are left uncoated and the narrowing of the hair entrance port is prevented. Such ports can be the gaps between the tines of comb-like cutting parts, or screen holes in the case of shear-foils.

SUMMARY OF THE INVENTION

It is an object of this invention to provide a process which coats the cutting parts of an electric dry shaver with a solid lubricant while leaving uncoated the cutting edges and without narrowing the hair entrance ports.

Briefly stated, and according to an aspect of this invention, the foregoing object is achieved by providing a process for coating the cutter parts of an electric dry shaver in which a meshed member is positioned over the surface of the cutter parts. A solid lubricant preparation penetrates the meshed member, and the meshed member is then removed from the cutter parts.

DETAILED DESCRIPTION

A meshed member such as a tissue, preferably consisting of polyester threads, is placed over the cutting parts of the electric dry shaver desired to be coated with a solid lubricant preparation. The cutting parts may be a shear-foil with its raised perforated edges and/or the blades of a long-hair cutter.

When coating a shear-foil, it is preferable to use a meshed member such as a tissue of polyester threads having a mesh opening of 45 to 50 microns and a thickness of 90 to 95 microns. When coating comb-like cutting parts, it is preferable to use a meshed member such as a tissue made up of polyester threads having a mesh opening of 25 to 30 microns and a thickness of 67 to 72 microns.

Preparations containing solid lubricants known as glide lacquers, which harden by curing, are suitable for the practice of this invention. As used in the following examples, a preparation containing 25% to 45% molybdenumdisulphide by weight and preferably 40% by weight in a binder hardening in air, is also suitable in practicing this invention. The viscosity of the preparation containing this solid lubricant is preferably 10 to 14 Pascal/Second, measuring with a Haak rotating viscometer.

The preparation containing the solid lubricant penetrates the meshed member such as a tissue and adheres only on the surfaces of the cutting parts lying underneath, while it adheres to the tissue in the hair entrance ports. With shear-foils having raised perforated edges, adhesions of the preparation containing the solid lubricant on the raised perforated edges are also removed when the tissue is pulled off.

EXAMPLE I

A tissue of polyester threads with a opening of 49 microns and a thickness of 93 microns is placed on the underside of a shear-foil with raised perforated edges, and a preparation containing molybdenumdisulphide 40% by weight in a binder hardening in air, is applied. The preparation has a viscosity of 10 Pascal/Second. With a coating tool, the preparation is pressed through the tissue. The tissue is then pulled off. The shear-foil is kept in a circulating air oven at 100° C. for 20 minutes. In this manner, a shear-foil is obtained with which only the trough between the raised perforated edges is coated with a solid lubricant coat.

EXAMPLE II

A tissue of polyester threads with a mesh opening of 27 microns and a thickness of 70 microns is placed on the upper side of the blades of a long-hair cutter. A preparation containing molybdenumdisulphide, 40% by weight in a binder hardening in air, is applied. The preparation has a viscosity of 10 Pascal/Second. With a coating tool, the preparation is pressed through the tissue. The tissue is then pulled off. The cutter-blade is kept in a circulating air oven at 100° C. for 20 minutes. A long-hair cutter is obtained in which only the upper side of the blades is coated with a solid lubricant coat while the ports between the tines remain uncoated.

While an embodiment and application of this invention has been shown and described, there will be apparent to those skilled in the art that modifications are possible without departing from the inventive concept herein described. The invention, therefore, is not to be restricted except as necessary by the prior art and by the spirit of the appended claims.

What is claimed as new and desired to be secured by Letters Patent of the United States is:

1. A process for coating the cutter parts of an electric dry shaver comprising:
   - positioning a meshed member having polyester threads over the surface of the cutter parts;
   - penetrating the meshed member with a solid lubricant preparation which includes molybdenumdisulphide in a binder capable of hardening in air; and
   - pulling off the meshed member.

2. The process as in claim 1 wherein the step of penetrating includes the step of pressing the solid lubricant preparation through the meshed member.

3. The process as in claim 1 wherein the step of penetrating includes the step of applying a solid lubricant preparation to the meshed member and pressing the solid lubricant preparation through the meshed member.

4. The process as in claim 1 wherein the solid lubricant preparation has a viscosity of 10 to 14 Pascal/-Second, measured with a Haak rotating viscometer.

5. The process as in claim 1 wherein the cutter parts are shear-foils with raised perforated edges and the meshed member has a mesh opening of 45 to 50 microns and a thickness of 90 to 95 microns.

6. The process as in claim 1 wherein the cutter parts are comb-like in structure and the meshed member has a opening of 25 to 30 microns and a thickness of 67 to 72 microns.

7. The process as in claim 1 wherein the solid lubricant preparation is a glide lacquer which hardens by curing.

8. A process coating the underside of a shear-foil with raised perforated edges comprising:

positioning a meshed member of polyester threads with a mesh opening of approximately 49 microns and a thickness of approximately 93 microns on the undeside of the shear-foil;

applying a solid lubricant preparation containing 25% to 45% weight and preferably 40% by weight of molybdenumdisulphide in a binder capable of hardening in air, the solid lubricant preparation having a viscosity of 10 Pascal/Second;

pressing the solid lubricant preparation through the meshed member;

pulling off the meshed member; and appling circulating air at approximately 100° C. to the shear-foil for approximately 20 minutes.

9. A process for coating the blades of a long-hair cutter comprising:

positioning a meshed member made up of polyester threads with a mesh opening of approximately 27 microns and a thickness of approximately 70 microns on the upper side of the blades of a long-hair cutter;

applying a solid lubricant preparation containing 40% by weight of molybdenumdisulphide in a binder capable of hardening in air, the solid lubricant preparation having a viscosity of 10 Pascal/-Second;

pressing the solid lubricant preparation through the meshed member;

pulling off the meshed member; and applying circulating air at approximately 100° C. to the long-hair cutter for approximately 20 minutes.

* * * * *